US009544966B2

(12) United States Patent
De Bruycker et al.

(10) Patent No.: US 9,544,966 B2
(45) Date of Patent: Jan. 10, 2017

(54) DRIVER DEVICE AND DRIVING METHOD FOR DRIVING A LOAD, IN PARTICULAR A LED UNIT

(71) Applicant: KONINKLIJKE PHILIPS N.V., Eindhoven (NL)

(72) Inventors: Patrick Alouisius Martina De Bruycker, Nuenen (NL); Dmytro Viktorovych Malyna, Eindhoven (NL); Harald Josef Günther Radermacher, Aachen (DE)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/375,225

(22) PCT Filed: Jan. 25, 2013

(86) PCT No.: PCT/IB2013/050646

§ 371 (c)(1),
(2) Date: Jul. 29, 2014

(87) PCT Pub. No.: WO2013/114255

PCT Pub. Date: Aug. 8, 2013

(65) Prior Publication Data

US 2015/0022107 A1 Jan. 22, 2015

Related U.S. Application Data

(60) Provisional application No. 61/593,354, filed on Feb. 1, 2012.

(30) Foreign Application Priority Data

Jul. 3, 2012 (EP) ..... 12174777

(51) Int. Cl.
*H05B 37/02* (2006.01)
*H05B 33/08* (2006.01)

(52) U.S. Cl.
CPC ..... *H05B 33/0851* (2013.01); *H05B 33/0809* (2013.01); *H05B 33/0815* (2013.01); *H05B 37/02* (2013.01)

(58) Field of Classification Search
CPC ..... H05B 37/02; H05B 33/08
(Continued)

(56) References Cited

U.S. PATENT DOCUMENTS 7,667,408 B2 * 2/2010 Melanson ..... H05B 33/0809 315/209 R
2009/0251059 A1 10/2009 Veltman
(Continued)

FOREIGN PATENT DOCUMENTS

EP 2282608 A2 2/2011
JP 1998257011 A 10/1988
(Continued)

*Primary Examiner* — Tung X Le

(57) ABSTRACT

The present invention relates to a driver device (30) for driving a load (32), in particular an LED unit (32) having one or more LEDs, comprising input terminals (45) for receiving an input voltage (V14) from an external power source (12) for powering the load (32), a current path (46) including a controllable switch (50) for connecting the input terminals (45) to each other, a measurement path (48) including a resistor (56, 58, 84, 86) connecting the input terminals (45) to each other for providing an alternating voltage corresponding to the input voltage (V14) and including a measuring device (64, 70) for measuring the alternating voltage (V15) at the measurement path (48), and a controller (54, 62) for controlling the controllable switch (50) on the basis of the measured alternating voltage.

13 Claims, 6 Drawing Sheets

(58) Field of Classification Search
USPC .... 315/200 R, 224, 287, 291, 294, 306, 307
See application file for complete search history.

(56) References Cited

U.S. PATENT DOCUMENTS

| | | | | |
|---|---|---|---|---|
| 2010/0253235 | A1 | 10/2010 | Tsai | |
| 2010/0259196 | A1* | 10/2010 | Sadwick et al. | 315/309 |
| 2010/0283403 | A1* | 11/2010 | Gray | H02M 1/15 315/291 |
| 2011/0043121 | A1* | 2/2011 | Matsuda | H05B 33/0815 315/224 |
| 2011/0127925 | A1 | 6/2011 | Huang et al. | |
| 2011/0285301 | A1* | 11/2011 | Kuang et al. | 315/200 R |
| 2011/0309759 | A1* | 12/2011 | Shteynberg et al. | 315/201 |

FOREIGN PATENT DOCUMENTS

| | | | |
|---|---|---|---|
| JP | 2000292837 | A | 10/2000 |
| JP | 2006172806 | A | 6/2006 |
| JP | 200627861 | A | 10/2009 |
| JP | 2010212267 | A | 9/2010 |
| JP | 2011054538 | A | 3/2011 |
| WO | WO2011013060 | A2 | 2/2011 |
| WO | 2011042510 | A1 | 4/2011 |
| WO | WO2011045057 | A1 | 4/2011 |

* cited by examiner

DRIVER DEVICE AND DRIVING METHOD FOR DRIVING A LOAD, IN PARTICULAR A LED UNIT

CROSS-REFERENCE TO PRIOR APPLICATIONS

This application is the U.S. National Phase application under 35 U.S.C. §371 of International Application No. PCT/IB13/050646, filed on Jan. 25, 2013, which claims the benefit of, U.S. Provisional Patent Application No. 61/593,354, filed on Feb. 1, 2012 and European Patent Application No 12174777.8 filed on Jul. 3, 2012. These applications are hereby incorporated by reference herein.

FIELD OF THE INVENTION

The present invention relates to a driver device and the corresponding driving method for driving a load, in particular an LED unit comprising one or more LEDs. Further, the present invention relates to a light apparatus.

BACKGROUND OF THE INVENTION

In the field of LED drivers for offline applications such as retrofit lamps, solutions are demanded to cope with efficiency, high power density, long lifetime, high power factor and low cost among other relevant features. While practically all existing solutions comprise one or another requirement, it is essential that the proposed driver circuits properly condition the form of the mains energy to the form required by the LEDs while remaining in compliance with present and future power mains regulations. In addition, it is required that the driver circuits comply with existing power adjustments, e.g. dimmers or the like, so that the drivers can be used universally as a retrofit driver device including the LED units.

Dimmable LED retrofit lamps need to be compatible with a wide range of existing dimmers. Most of those dimmers are designed for operation with incandescent light bulbs. However, the input characteristics of LED retrofit lamps can be quite different from those of incandescent light bulbs. Therefore, special driver devices are required for correct operation of the dimmers and the LED lamps.

The driver circuits should comply with all kinds of dimmers, especially phase-cut dimmers, which are preferably used to regulate the mains voltage with low power loss. Those dimmers are usually used to regulate the mains energy provided to an incandescent light bulb which needs a low load impedance path for a timing circuit operating current to adjust the phase-cut timing. The provision of this low load impedance path has to be adjusted to the zero crossing of the mains voltage, in particular at low power operation of the LEDs. In particular, during low power operation, a high impedance path has to be provided before the zero crossing and the low impedance path has to be provided after the zero crossing.

EP 2 282 608 A2 discloses a light apparatus comprising an LED assembly including a current sensor to detect the zero crossing of the supply voltage. The current sensor comprises a plurality of measurement resistors which detect the current provided by the power supply to the LED units. This current measurement unit influences the current provided to the LEDs and reduces the power factor due to the high power loss within the measurement resistors.

SUMMARY OF THE INVENTION

It is an object of the present invention to provide a driver device and a corresponding driving method for driving a load, in particular an LED unit comprising one or more LEDs, providing compatibility to different dimmer devices, in particular to phase-cut dimmers, with low technical effort and a high power factor. Further, it is an object of the present invention to provide a corresponding light apparatus.

According to one aspect of the present invention, a driver device is provided comprising:

- input terminals for receiving an input voltage from an external power source for powering the load,
- a current path including a controllable switch for connecting the input terminals to each other,
- a measurement path including a resistor connecting the input terminals to each other for providing an alternating voltage corresponding to the input voltage and including a measuring device for measuring the alternating voltage at the measurement path, and
- a controller for controlling the controllable switch on the basis of the measured alternating voltage.

According to another aspect of the present invention, a driving method for driving a load, in particular an LED unit comprising one or more LEDs, is provided, wherein the driving method comprises the steps of:

- receiving an input voltage from an external power supply at input terminals,
- connecting the input terminals by means of a measurement path including a resistor,
- measuring an alternating voltage corresponding to the input voltage at the measurement path,
- connecting the input terminals to each other by means of a current path including a controllable switch on the basis of the measured voltage.

According to still another aspect of the present invention, a light apparatus is provided comprising a light assembly comprising one or more light units, in particular an LED unit comprising one or more LEDs, and a driver device for driving said assembly as provided according to the present invention.

Preferred embodiments of the invention are defined in the dependent claims. It should be understood that the claimed method has similar and/or identical preferred embodiments as the claimed device and as defined in the dependent claims.

The present invention is based on the idea to measure the input voltage by means of a high resistance path of the driver device to adapt the impedance of the driver device to the input voltage to prevent the driver device from providing a charge current to the power supply and, in particular, to prevent a timing circuit of a connected dimmer from being charged. Further, the measurement path provides a robust measuring signal to measure the input voltage. Hence, a precise measurement of the input voltage can be provided and the phase of the input voltage can be precisely detected without providing a leakage current to the power supply and, in particular, without influencing the timing of the dimmer.

The present invention further provides a simple and precise solution to adapt the internal resistance of the driver device for driving a load to comply with various existing dimmers.

In a preferred embodiment, the measuring device is provided for detecting a zero crossing of the input voltage. This provides a simple solution to adjust the impedance of the driver device to a connected dimmer device.

In a further embodiment, the controller is provided for activating the current path when or after the zero crossing is detected. This provides a current path to charge a timer circuit of a dimmer device such that the dimmer device operates as desired without a shift of the phase angle.

In a preferred embodiment, the driver device comprises a rectifier unit for rectifying the input voltage, wherein the measurement path is connected to the rectifier unit. This is a simple solution for converting a bipolar voltage, e.g. mains voltage, to a unipolar voltage, in particular to drive an LED unit.

In a preferred embodiment, the current path comprises a resistor, wherein a resistance of the measurement path is larger than the resistance of the current path. This provides a simple solution for a measurement path, which does not influence the timing circuit of a connected dimmer, and for providing a current path for charging the timing circuit of the dimmer when necessary.

In a further embodiment, one of the input terminals is connected to a voltage converter unit which is connected to the external power source, wherein the voltage converter is a phase-cutting device provided for cutting a phase of the input voltage and for providing a phase-cut AC voltage to the driver device. This provides variable power supply having a high power factor and low power loss due to the phase cutting of the input voltage.

In a further embodiment, the measuring device comprises a sampling unit for sampling the alternating voltage. This provides a simple and precise possibility to measure the input voltage without providing a leakage current to the power supply and, in particular, without influencing the timing circuit of the dimmer device.

According to this embodiment, it is preferred that the measuring device comprises a controllable switch for connecting the input terminals to each other to measure the alternating voltage. This provides a simple solution for sampling the alternating voltage without providing an undesired leakage current.

According to a preferred embodiment, the measurement path comprises a resistor divider including a first resistor and a second resistor, and wherein the resistance of the second resistor is lower than the resistance of the first resistor. This is a simple solution to provide a robust alternating voltage, which can be measured precisely with low technical effort.

In this embodiment, it is preferred that the measurement path comprises a rectifier unit, with the first resistor being connected in series to the rectifier unit and the second resistor being connected in parallel to the rectifier unit. This provides a simple solution, enabling to provide a high resistance measurement path integrated in the rectifier unit.

In a preferred embodiment, the resistance of the first resistor is at least 1 MOhm, and preferably 2 MOhm. This provides a measurement path having a resistance which is high enough to prevent a leakage current to the timing circuit of the dimmer device and low enough to have a robust measurement signal.

As mentioned above, the present invention provides an improved driver device for driving a load, wherein the impedance of the driver device is adapted to the input voltage and wherein a leakage current provided to the external power supply is reduced and, in particular, the timing circuit of a connected dimmer device is prevented from being charged. Further, the present invention preferably provides a possibility to precisely measure the zero crossing of the input voltage with low technical effort by using the resistance of the measurement path and the internal impedance of the attached dimmer device. Hence, the input voltage can be detected and the impedance of the driver device can be adjusted to the zero crossing of the input voltage such that the dimmer device operates as desired for all different power ranges.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
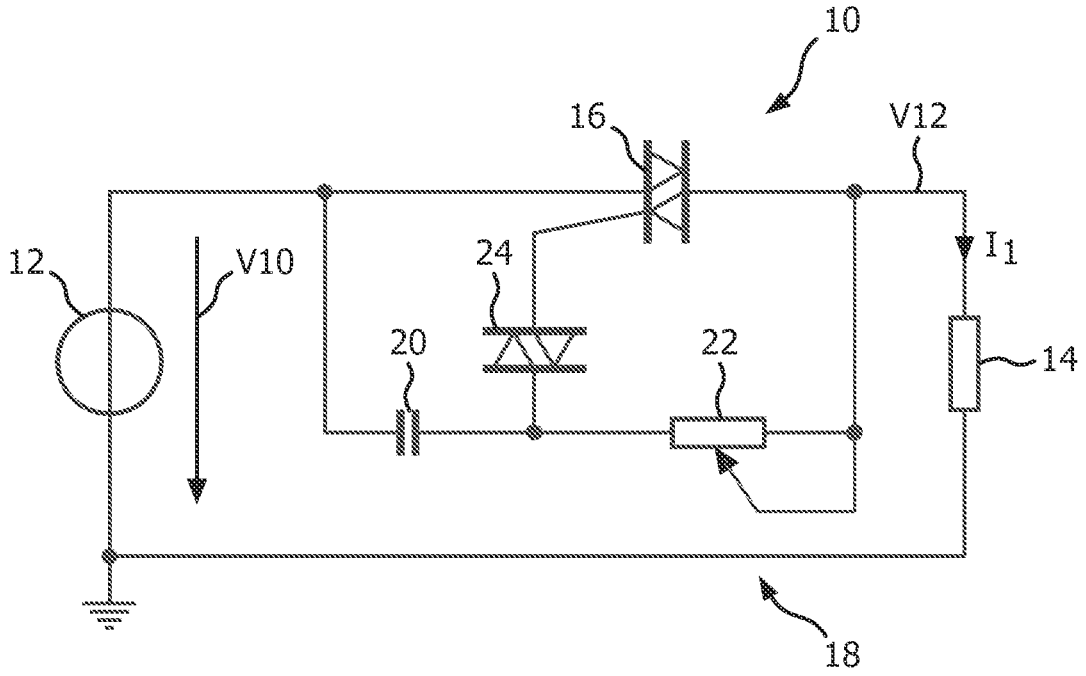
FIG. 1 shows a schematic block diagram of a dimmer device connected to an incandescent lamp.

FIG. 1 shows a schematic block diagram of a dimmer device generally denoted by 10. The dimmer device 10 is connected to an external voltage supply 12, which is preferably the mains, which provides a supply voltage V10. The dimmer device 10 provides a modified input voltage V12 having a leading edge phase-cut and a load current I1 to a load 14. The load 14 may be an incandescent bulb lamp.

The dimmer device 10 comprises a triac 16 for connecting the external voltage supply 12 to the load 14. Parallel to the triac a timing circuit 18 is connected. The timing circuit 18 comprises a timing capacitor 20, a variable resistor 22 and a diac 24, which is connected to the triac 16. The voltage of the charge capacitor 20 is provided to the diac 24 which switches the triac 16. When the charge of the charge capacitor 20 reaches a predefined level, the diac 24 is switched on, the triac 16 is switched on by the diac 24 and the supply voltage V10 is provided to the load 14. When the triac 16 is switched off, the supply voltage V10 is provided to the charge capacitor 20. Hence, the charge capacitor 20 of the timing circuit 18 is charged up to a predefined voltage level, at which the diac is switched. As soon as the predefined voltage is reached, the triac 16 is switched on again and the charge capacitor 20 is discharged to a forward voltage of the diac 24.

During a phase when the triac 16 is switched on, the voltage across the timer circuit 18 is zero and the charge capacitor 20 is not charged. The triac 16 connects the external voltage supply 12 to the load 14 until the current through the triac 16 and thus the load current I1 drops below the hold current of the triac 16. Then the triac is switched off and the charging of the charge capacitor 20 starts again.

If the load 14 is an incandescent bulb lamp, the triac 16 remains in the conducting state until, or just before, the zero crossing of the input voltage V10 is reached. The impedance of the load 14 is low enough to ensure a high enough load current I1 to ensure the conduction of the triac 16 up to the zero crossing.

If the load 14 is an LED unit, a normal operation comparable to the operation with an incandescent bulb (incandescent-like operation) can be assured only if the triac current, i.e. the load current I1, is larger than the hold current of the triac 16. This can be achieved only for corresponding power levels (e.g. 10 W) having a respective load current I1. Below this power level, the power dissipation has to be increased. Further, most of the SSL retrofit lamps are operated below that level. Hence, it is inevitable to switch the triac 16 off before the zero crossing as described below.

Figure 2:
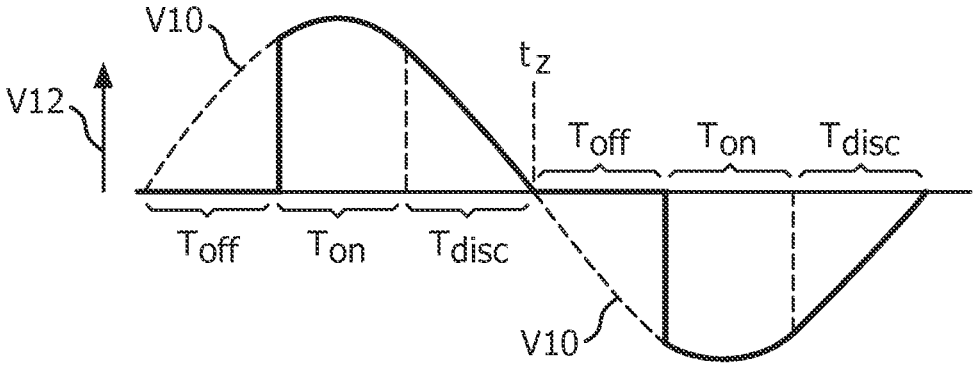
FIG. 2 shows a diagram illustrating the voltage supplied by the dimmer device.

In FIG. 2, a diagram of the input voltage V12 provided by the dimmer device 10 is schematically shown. Each half cycle of the supply voltage V10 (dashed line) comprises three different phases, of which the first phase is the off phase $T_{off}$ when the triac 16 is switched off and the input voltage V12 is zero. The second phase is the on phase $T_{on}$ following the off phase $T_{off}$, when the triac 16 is conducting and the input voltage V12 (solid line) is identical with the supply voltage V10. After the on phase $T_{on}$, a disconnection phase $T_{disc}$ is provided wherein the triac 16 is switched off. During this disconnection phase $T_{disc}$, the load impedance should be increased to avoid charging of the charge capacitor 20 and to avoid early switching of the diac 16. During this disconnection phase $T_{disc}$, the impedance of the load 14 should be larger than the impedance of the timer circuit 18. Preferably, the impedance of the load 14 during the disconnection phase $T_{disc}$ should be at least 2 MOhm. After a zero crossing $t_z$, the off phase $T_{off}$ of the following half cycle of the supply voltage V10 begins. During this off phase $T_{off}$, the impedance of the load 14 should be low to charge the charge capacitor 20 in a way comparable to normal operation. Hence, the impedance of the load 14 has to be switched from the high impedance state to a low impedance state precisely at the zero crossing $t_z$ of the supply voltage V10.

To detect the zero crossing $t_z$ of the supply voltage V10 and to ensure operation of the timer circuit 18 comparable to normal operation, a measurement device is needed to precisely measure the zero crossing $t_z$ without affecting the timer circuit 18.

Figure 3:
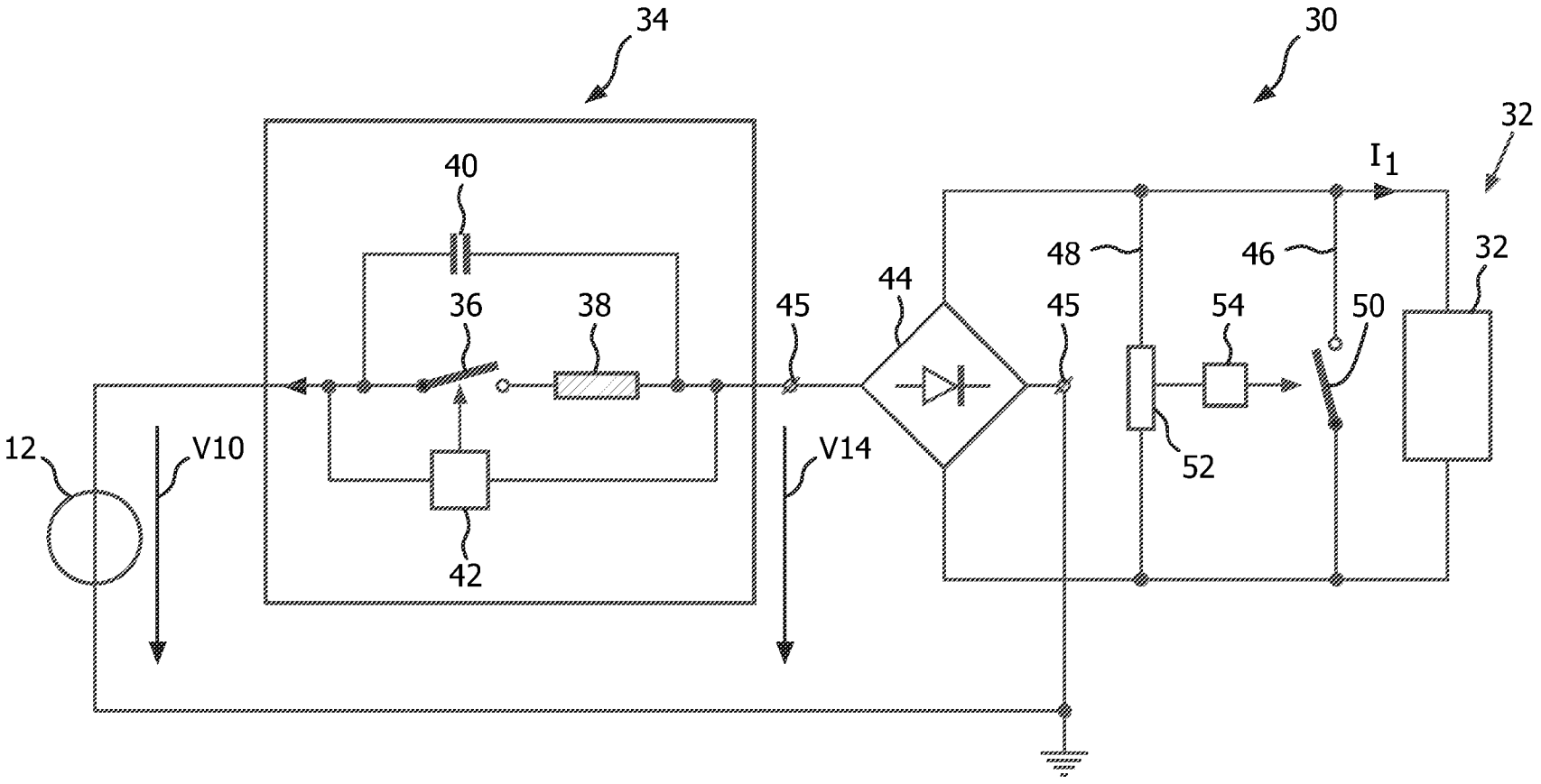
FIG. 3 shows an embodiment of a driver device connected to an external power supply including a measuring device for measuring the input voltage.

FIG. 3 shows a schematic block diagram of a driver device 30 according to the present invention for driving an LED unit 32. The driver device 30 is connected to a dimmer device 34, which is connected to the external power supply 12 providing the supply voltage V10.

The dimmer device 34 is schematically shown and comprises a controllable switch 36, preferably a triac 36, an inductor 38 and a capacitor 40 connected in parallel to the switch 36 and the inductor 38. The dimmer device 34 may be a leading or a trailing edge dimmer. Parallel to the controllable switch 36 and the inductor 38, a timing circuit 42 is connected for controlling the controllable switch 36.

The dimmer device 34 provides an alternating bipolar phase-cut input voltage V14 to the driver device 30.

The driver device 30 comprises a rectifier unit 44, which is connected to the dimmer device 34 and to neutral by means of input terminals 45 for rectifying the alternating phase-cut voltage V14. A connection path 46 and a measurement path 48 are connected in parallel to the rectifier unit 44. The LED unit 32 is connected in parallel to the rectifier unit 44 and to the connection path 46 and the measurement path 48. The driver device 30 provides the load current I1 to power the LED unit 32.

The connection path 46 comprises a controllable switch 50, which is switched on to connect the input terminals 45 of the driver device 30 to each other to provide the low impedance path during the off phase $T_{off}$ as described above.

The measurement path 48 comprises a resistor (not shown) and a measurement device 52 for measuring the phase-cut input voltage V14. Due to the resistor, the phase-cut input voltage V14 can be measured at the measurement path 48 during the disconnection phase $T_{disc}$ when the switch 50 is open. The measurement device 52 is connected to a controller 54, which is provided for controlling the controllable switch 50. Due to the resistance of the measurement path 48, the impedance of the driver device 30 is high during the disconnection phase $T_{disc}$ and the timing circuit 42 is not charged by a leakage current.

Hence, the phase-cut input voltage V10 can be measured by means of the measurement device 52 and the zero crossing $t_z$ can be detected. On the basis of the detected time of the zero crossing $t_z$, the switch 50 is closed to provide the current path 46 and to connect the input terminals 45. Hence, the zero crossing $t_z$ can be precisely detected without affecting the operation of the timing circuit 42.

Figure 4:
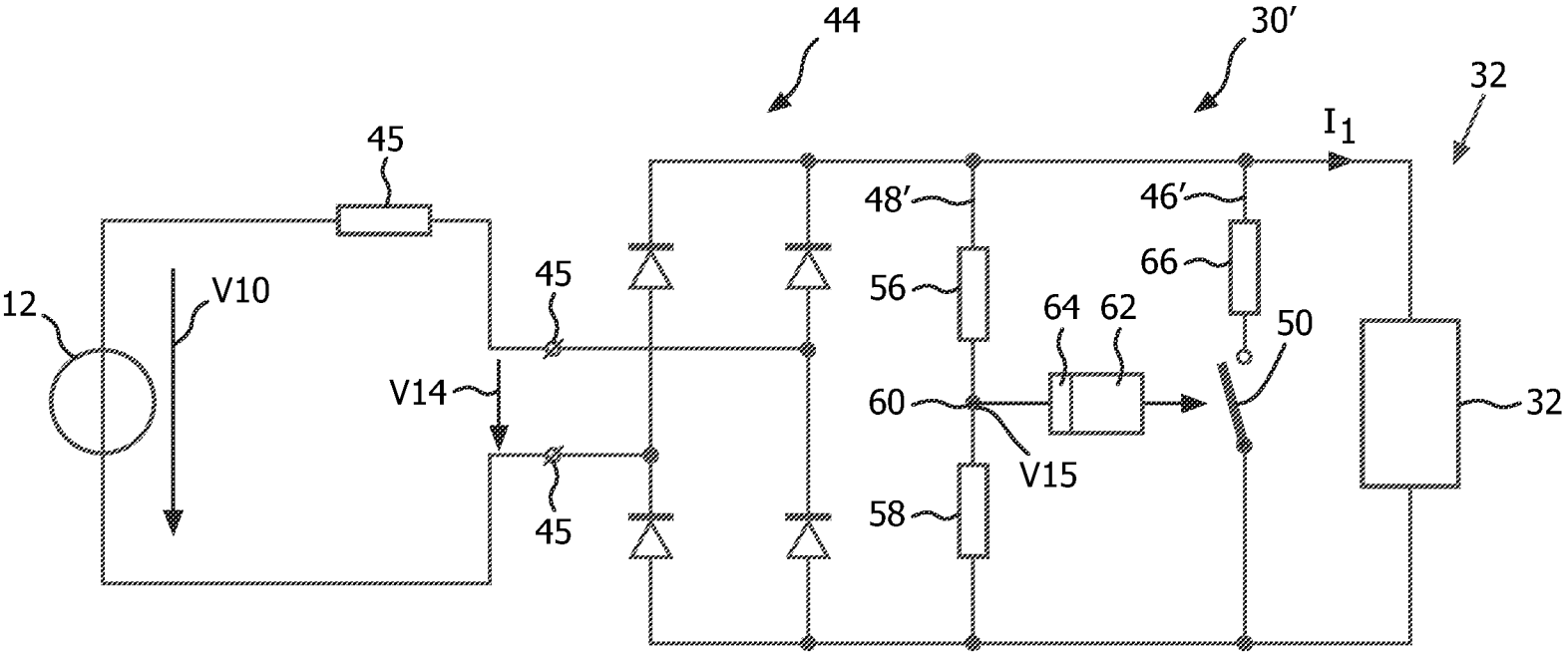
FIG. 4 shows one embodiment of the present invention including a high impedance path for detecting a zero crossing of the input voltage.

FIG. 4 shows a schematic block diagram of an embodiment of the present invention including the driver device 30'. Identical elements are denoted by identical reference numerals, wherein here only the differences are described in detail.

The rectifier unit 44 comprises four diodes for rectifying the phase-cut input voltage V14 to a unipolar voltage provided to the LED unit 32. The measurement path 48' comprises a first resistor 56 and a second resistor 58, which are connected in series to each other and form a resistor divider. Between the first resistor 56 and the second resistor 58 a voltage tap 60 is formed for measuring an alternating voltage V15 corresponding to the phase-cut input voltage V14. A control unit 62 including a measurement device 64 is connected to the voltage tap 60 to measure the voltage potential V15 between the first resistor 56 and the second resistor 58. The control unit 62 is connected to the controllable switch 50 to control the controllable switch 50 on the basis of the measured voltage potential at the voltage tap 60. The resistance of the first resistor 56 is larger than the resistance of the second resistor 58. The resistance of the first resistor 56 is preferably 2 MOhm and the resistance of the second resistor 58 is preferably 100 kOhm.

The connection path 46 comprises the controllable switch 50 connected in series to a resistor 66. The resistor 66 is provided for limiting the current in the connection path 46, wherein the resistance of the resistor 66 is preferably 1 kOhm.

Therefore, during the disconnection phase $T_{disc}$, when the controllable switch 50 is open, the impedance of the driver device 30' is only formed by the measurement path 48' including the first resistor 56 and the second resistor 58. Hence, during this phase, the alternating voltage V15 can be measured at the voltage tap 60 corresponding to the phase-cut voltage input V14, whereby the zero crossing $t_z$ can be detected. When the zero crossing $t_z$ is detected by the measurement device 64, the control unit 62 switches on the controllable switch 50 and connects the input terminals of the driver device 30' to each other to provide the low impedance path.

Consequently, the zero crossing $t_z$ can be easily detected and the impedance of the driver device 30' can be switched from a high impedance during the disconnection phase $T_{disc}$ to a low impedance during the off phase $T_{off}$.

Figure 5:
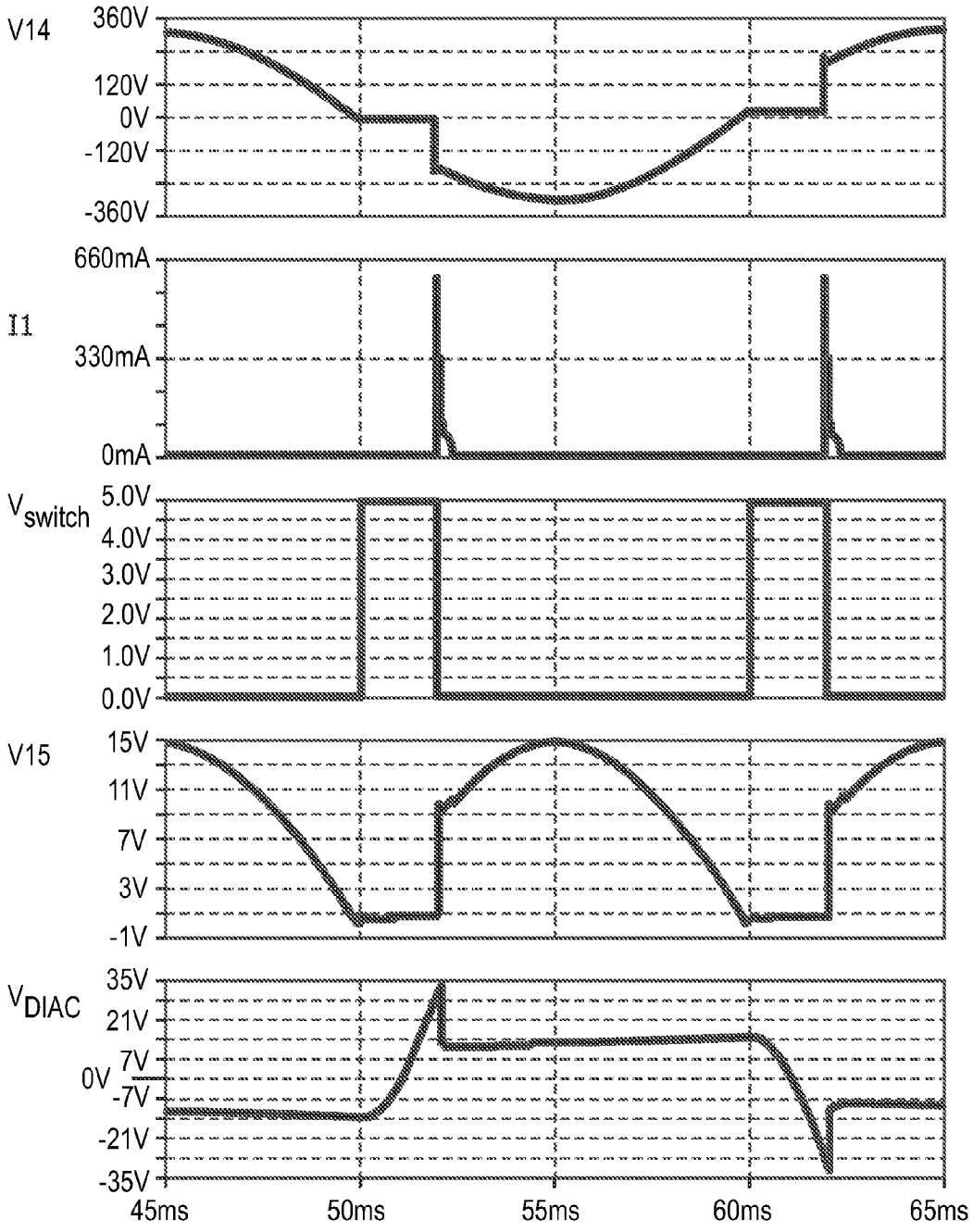
FIG. 5 shows a diagram illustrating waveforms of currents and voltages of the driver device and the dimmer of FIG. 4.

FIG. 5 shows a diagram illustrating the waveforms of the input voltage V14, the load current I1, a control voltage $V_{switch}$ for controlling the controllable switch 50, the voltage potential V15, and the voltage $V_{disc}$ across the diac 36 and the inductor 38.

As shown in FIG. 5, the input voltage V14 is a leading edge phase-cut voltage having a sinusoidal portion during the on phase $T_{on}$ and the disconnection phase $T_{disc}$ and a zero level during the off phase $T_{off}$. The load current I1 is a short peak current after the start of the on phase $T_{on}$. After the load current I1 is reduced to zero, the disconnection phase $T_{disc}$ begins. The control voltage $V_{switch}$ shows the active phase of the current path 46 during the off phase $T_{off}$. The alternating voltage V15 measured at the voltage tap 60 is a unipolar alternating voltage corresponding to the input voltage V14 in a rectified form. After the disconnection phase $T_{disc}$, the alternating voltage V15 is reduced to zero, so that the zero crossing $t_z$ can be easily detected. The voltage $V_{diac}$ across the diac 36 and the inductor 38 increases during the off phase $T_{off}$ until the diac 36 is switched on. After the switching of the diac 36, the voltage $V_{diac}$ is reduced rapidly and remains almost constant during the on phase and the disconnection phase. During the off phase $T_{off}$, the voltage $V_{diac}$ is increased again in the opposite direction.

Figure 6:
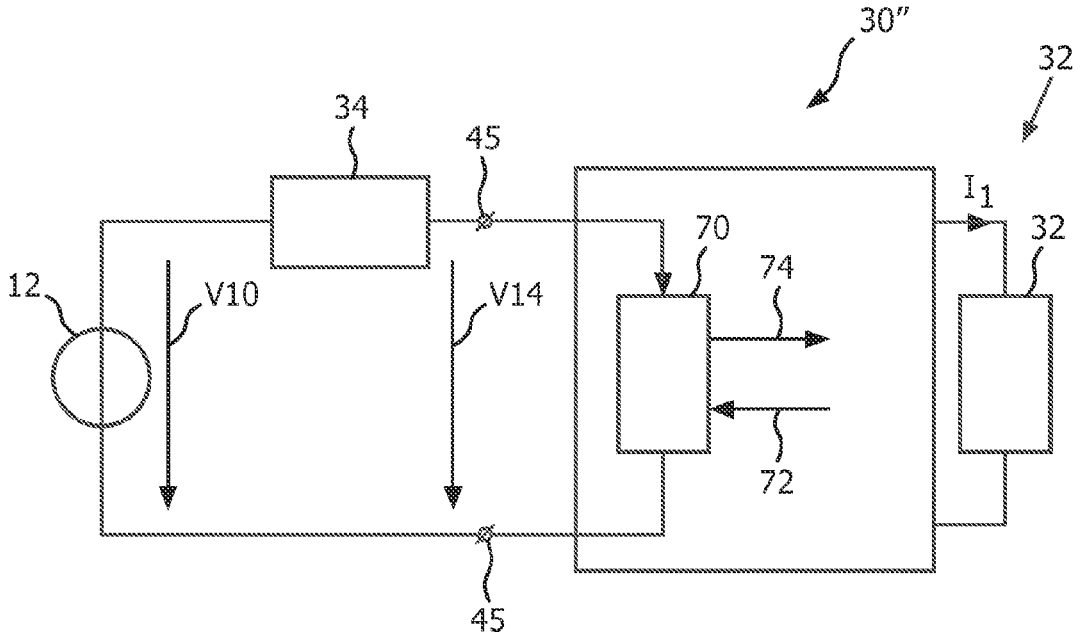
FIG. 6 shows a schematic block diagram of a second embodiment of the present invention including a sampling unit for detecting a zero crossing of the input voltage.

In FIG. 6, an alternative embodiment of the present invention is schematically shown including the driver device 30". Identical elements are denoted by identical reference numerals, and here only the differences are explained in detail.

The driver device 30" is connected to the dimmer device 34 and receives the phase-cut input voltage V14. The driver device 30" provides the load current I1 to the LED unit 32 to power the LED unit 32. The driver device 30" comprises a sampling unit 70, which is associated to the input terminals 45 of the driver device 30". The sampling unit 70 receives a sampling signal 72 and provides a sampled voltage signal 74 corresponding to the phase-cut voltage V14. Since the sampling unit 70 measures the phase-cut input voltage V14 periodically during very short time periods, the influence on the timing circuit 42 by the driver device 30" is very low.

Figure 7:
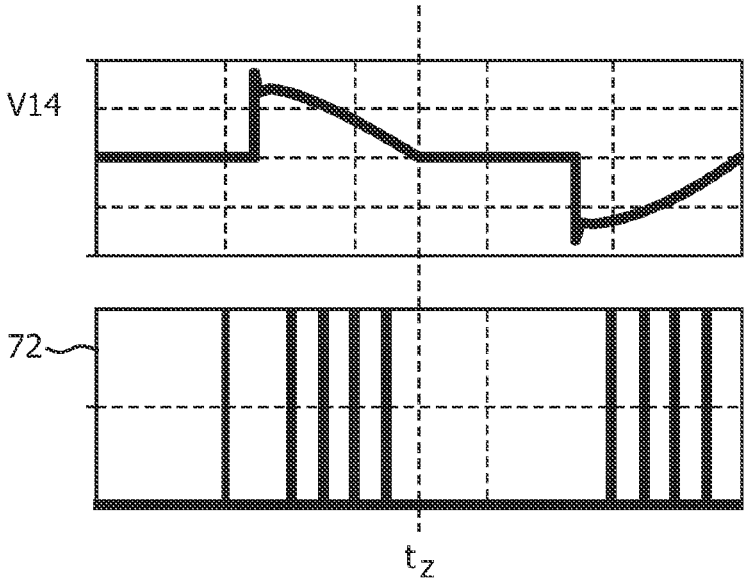
FIG. 7 shows a schematic diagram of the voltage supplied to the driver device and the sampling signal of the sampling unit.

In FIG. 7, the phase-cut input voltage V14 and the sampling signal 72 are schematically shown. The phase-cut input signal V14 is zero during the off phase $T_{off}$ and is an approximately sinusoidal signal during the on phase $T_{on}$ and the disconnection phase $T_{disc}$. After the zero crossing $t_z$, the off phase $T_{off}$ follows again.

The sampling signal 72 shows, by way of example, four peaks, during which the sampling unit 70 measures the phase-cut input voltage V14. Since only the zero crossing $t_z$ has to be detected, the sampling signal 72 is only activated during the on phase $T_{on}$ and the disconnection phase $T_{disc}$. Since the peaks of the sampling signal 72 are very short, the influence on the timing circuit 42 by the measurement is very low.

Figure 8:
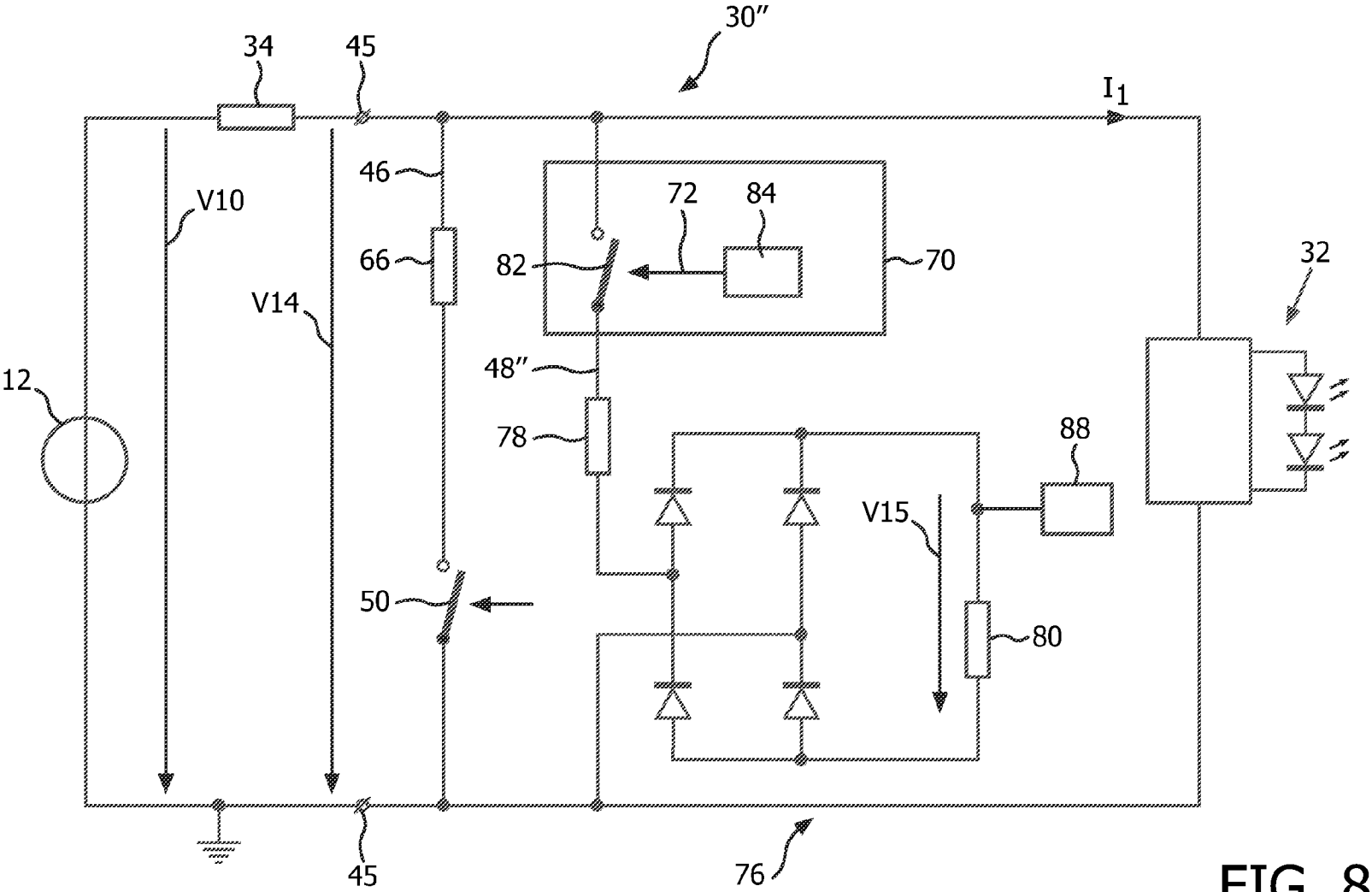
FIG. 8 shows a detailed schematic block diagram of a driver device for driving a load including a sampling unit for measuring the zero crossing of the input voltage.

In FIG. 8, a detailed schematic block diagram of an embodiment of the driver device 30" is shown. Identical elements are denoted by identical reference numerals, and here merely the differences are explained in detail.

The driver device 30" comprises the connection path 46 including the switch 50 and the resistor 66. The driver device 30" further comprises the measurement path 48" connected in parallel to the connection path 46 and in parallel to the load 32. The measurement path 48" comprises the sampling unit 70 connected in series with a rectifier unit 76. A first resistor 78 is connected between the rectifier unit 76 and the sampling unit 70. A second resistor 80 is connected in parallel to the rectifier unit 76. The resistors 78, 80 are connected to the rectifier unit 76 such that the resistors 78, 80 are connected in series to each other in any case, i.e. for both polarity directions of the input voltage V14. The resistance of the first resistor 78 is larger than the resistance of the second resistor 80. The driver device 30" provides the load current I1 to power the LED unit 32.

The sampling unit 70 comprises a controllable switch 82, which connects the rectifier unit 76 and the first resistor 78 and the second resistor 80 to, and disconnects them from, the dimmer device 34. The controllable switch 82 is controlled in such a way that it samples the alternating input voltage V14 during the disconnect phase $T_{disc}$. The timing of the sampling is controlled by the sampling signal 72 provided by a sampling device 84. When the controllable switch 82 is closed, the resistors 78, 80 are connected to the input terminals 45 and the alternating voltage V15 is measured at the measurement path 48" as described above. A measurement unit 88 is connected to the measurement path 48" preferably at the second resistor 80 to detect the alternating voltage V15 across the second resistor 80. The measured alternating voltage V15 corresponds to the phase-cut input voltage V14 due to the resistor divider formed of the first resistor 78 and the second resistor 80.

Hence, the measurement unit 88 measures the voltage potential V15 corresponding to the phase-cut input voltage V14 to detect the zero crossing $t_z$ of the input voltage V10 and controls the controllable switch 50 on the basis of the detected zero crossing $t_z$. Due to the large resistance of the first resistor 78 and the low resistance of the second resistor 80, low voltage diodes can be used for the rectifier unit 76 having a low capacitance which has no influence, or a reduced influence, on the measurement.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

A computer program may be stored/distributed on a suitable medium, such as an optical storage medium or a solid-state medium supplied together with or as part of other hardware, but may also be distributed in other forms, such as via the Internet or other wired or wireless telecommunication systems.

Any reference signs in the claims should not be construed as limiting the scope.

The invention claimed is:

1. A driver device for driving a load, in particular an LED unit having one or more LEDs, comprising:

input terminals for receiving an input voltage from an external power source for powering the load, a current path including a controllable switch for connecting the input terminals to each other, a measurement path including a resistor connecting the input terminals to each other for providing an alternating voltage corresponding to the input voltage and including a measuring device for measuring the alternating voltage at the measurement path, wherein the measuring device is configured to detect a zero crossing (tz) of the input voltage, and a controller for controlling the controllable switch on the basis of the measured alternating voltage, wherein the controller is configured to connect the input terminals to each other by means of the current path upon detecting a zero crossing (tz) of the input voltage, and to disconnect the input terminals from each other by means of the current path before a second zero crossing of the input voltage.

2. A driver device as claimed in claim 1, further comprising a rectifier unit for rectifying the input voltage, wherein the measurement path is connected to the rectifier unit.

3. A driver device as claimed in claim 2, wherein the current path comprises a resistor, wherein a resistance of the measurement path is larger than the resistance of the current path.

4. A driver device as claimed in claim 3, wherein at least one of the input terminals is connected to a phase-cutting device which is connected to the external power source, wherein the phase-cutting device is provided for cutting a phase of a supply voltage of the power source and for providing a phase cut AC voltage as the input voltage to the driver device.

5. A driver device as claimed in claim 4, wherein the measuring device comprises a sampling unit for sampling the alternating voltage.

6. A driver device as claimed in claim 5, wherein the measuring device comprises the controllable switch for connecting the input terminals to each other to measure the alternating voltage.

7. A driver device as claimed in claim 6, wherein the measurement path comprises a resistor divider including the first resistor and a second resistor, and wherein the resistance of the second resistor is lower than the resistance of the first resistor.

8. A driver as claimed in claim 7, wherein the measurement path comprises the rectifier unit and wherein the first resistor is connected in series to the rectifier unit and wherein the second resistor is connected in parallel to the rectifier unit.

9. A driver device as claimed in claim 8, wherein the resistance of the first resistor is at least 1 MOhm.

10. A light apparatus comprising:

a light assembly comprising one or more light units, in particular an LED unit comprising one or more LEDs, and a driver device for driving said light assembly as claimed in claim 1.

11. A driving method for driving a load, in particular an LED unit comprising one or more LEDs, the driving method comprising the steps of:

receiving an input voltage from an external power supply at input terminals, connecting the input terminals by means of a measurement path including a resistor, measuring an alternating voltage corresponding to the input voltage at the measurement path and detecting of a zero crossing (tz) of the input voltage, connecting the input terminals to each other by means of a current path including a controllable switch upon detecting a zero crossing (tz) of the input voltage, disconnecting the input terminals from each other by means of the current path including the controllable switch before a second zero crossing of the input voltage.

12. A driver device for driving a load, in particular an LED unit having one or more LEDs, comprising:

input terminals for receiving an input voltage from an external power source for powering the load, a current path including a controllable switch for connecting the input terminals to each other, a measurement path including a resistor connecting the input terminals to each other for providing an alternating voltage corresponding to the input voltage and including a measuring device for measuring the alternating voltage at the measurement path, wherein the measuring device is configured to detect a zero crossing (tz) of the input voltage, and a controller for controlling the controllable switch on the basis of the measured alternating voltage, wherein the measuring device is configured to detect a zero crossing (tz) of the input voltage, wherein the measurement path comprises a resistor divider including the first resistor and a second resistor, and wherein the resistance of the second resistor is lower than the resistance of the first resistor, wherein the measurement path comprises a rectifier unit and wherein the first resistor is connected in series to the rectifier unit and wherein the second resistor is connected in parallel to the rectifier unit.

13. A driver device as claimed in claim 12, wherein the resistance of the first resistor is at least 1 MOhm.

* * * * *